US007793789B2

(12) United States Patent
Psaradellis

(10) Patent No.: US 7,793,789 B2
(45) Date of Patent: Sep. 14, 2010

(54) MODEL CAR DISPLAY SYSTEM AND USE THEREOF

(75) Inventor: John Psaradellis, Palatine, IL (US)

(73) Assignee: Stages Die Cast Display Systems, Inc., Palatine, IL (US)

( * ) Notice: Subject to any disclaimer, the term of this patent is extended or adjusted under 35 U.S.C. 154(b) by 544 days.

(21) Appl. No.: 11/416,439

(22) Filed: May 3, 2006

(65) Prior Publication Data

US 2007/0256988 A1 Nov. 8, 2007

(51) Int. Cl.
*A47F 7/00* (2006.01)

(52) U.S. Cl. ..... 211/13.1

(58) Field of Classification Search ..... 312/125, 312/114, 107, 263, 350, 117; 108/149, 152; 40/431, 427, 429, 430, 800; 446/7, 129, 446/236, 423; 211/87.01, 13.1, 90.01, 90.02, 211/187; 248/220.1; D6/450, 563, 470, D6/472; 362/125; 206/736, 756, 769
See application file for complete search history.

(56) References Cited

U.S. PATENT DOCUMENTS

| | | | | | |
|---|---|---|---|---|---|
| 2,040,521 | A | * | 5/1936 | Marx | 446/423 |
| 2,731,765 | A | * | 1/1956 | Carver | 446/409 |
| 3,171,636 | A | * | 3/1965 | Barlow et al. | 366/141 |
| 3,471,963 | A | * | 10/1969 | Tomiyama | 446/429 |
| 3,735,525 | A | * | 5/1973 | Freed | 446/435 |
| 3,986,717 | A | * | 10/1976 | Kirby et al. | 463/62 |
| 4,260,041 | A | * | 4/1981 | Mabuchi | 185/40 R |
| 4,274,225 | A | * | 6/1981 | Knauff et al. | 446/409 |
| 4,767,375 | A | * | 8/1988 | Fassman | 446/423 |
| 5,313,728 | A | * | 5/1994 | Tien | 40/420 |
| 5,456,604 | A | | 10/1995 | Olmsted et al. | |
| 5,560,500 | A | | 10/1996 | Wilcox | |
| D395,562 | S | | 6/1998 | Goodman | |
| 5,865,516 | A | | 2/1999 | Woy | |
| 5,924,778 | A | | 7/1999 | TenBrink | |
| 5,941,176 | A | | 8/1999 | Schultz et al. | |

(Continued)

OTHER PUBLICATIONS http://www.gmdiecast.com/products/default.cfm?category=Dioramas; GMP Limited Edition Replicas Dioramas.

(Continued)

*Primary Examiner*—Jennifer E. Novosad
(74) *Attorney, Agent, or Firm*—K&L Gates LLP

(57) ABSTRACT

A model car display system adapted to display a model car, such as a die-cast model car, in association with dioramic and scenic elements to recreate a realistic and scaled down automobile-related scene. In one illustrated embodiment, the system is adapted to associate one or more model cars with scenery corresponding to a race track-like drag race scene by which the model cars are positioned to appear as if preparing to race. The system may include various elements to increase the realism thereof. For example, the system may include various rotational means adapted for rotating the wheels of a model car associated with the system and various associating means for securely associating the model car with the system while its wheels are being rotated. By way of additional example, the system may interchangeably associate with a plurality of scenic elements so that the system may be configured to appear as any of a plurality of scenes, such as a race track, street race, historical scene, street, garage, and the like.

5 Claims, 9 Drawing Sheets

U.S. PATENT DOCUMENTS

| | | | | |
|---|---|---|---|---|
| 6,036,574 | A * | 3/2000 | Halford | 446/429 |
| D431,734 | S | 10/2000 | Edgell | |
| 6,179,686 | B1 * | 1/2001 | Ogawa et al. | 446/429 |
| 6,467,632 | B1 | 10/2002 | Guillot | |
| D472,739 | S | 4/2003 | Wimer | |
| D481,223 | S | 10/2003 | Locker et al. | |
| D494,386 | S | 8/2004 | Locker et al. | |
| 6,910,424 | B2 | 6/2005 | Ruocchio et al. | |
| D569,128 | S * | 5/2008 | Stearns et al. | D6/450 |
| 2004/0262184 | A1 | 12/2004 | Livesay | |
| 2005/0075037 | A1 * | 4/2005 | Whitehead | 446/129 |
| 2005/0122008 | A1 | 6/2005 | Atwood | |
| 2005/0145535 | A1 | 7/2005 | Augborne | |
| 2005/0218098 | A1 | 10/2005 | Angen et al. | |

OTHER PUBLICATIONS http://www.diecastxchange.com/forum1/index.php?act=module &module=gallery&cmd=sc&cat=2; DiecastXchange.com Dioramas.

http://www.tapplastics.com/applications/app__detail.php?aid=50; TAP Plastics, "The Scene at the Pit".

http://www.shorttracknews.com/diorama.html; Short Track News Dioramas.

http://www.legacydiecast.com/xq/asp/id.GMP1800130/qx/review.htm; GMP Drag Strip Diorama.

http://www.aceflairmo.web.aplus.net; All American Displays Website.

* cited by examiner

MODEL CAR DISPLAY SYSTEM AND USE THEREOF

FIELD OF THE INVENTION

The present invention is directed to a model car display system and use thereof. More particularly, the present invention is directed to a model car display system variously reconfigurable to realistically simulate a plurality of dioramic, automobile-related scenes.

BRIEF DESCRIPTION OF THE DRAWINGS

These and other features and a more thorough understanding of the present invention may be achieved by referring to the following description, taken in conjunction with the accompanying drawings, wherein.

SUMMARY OF THE INVENTION

Figure 1:
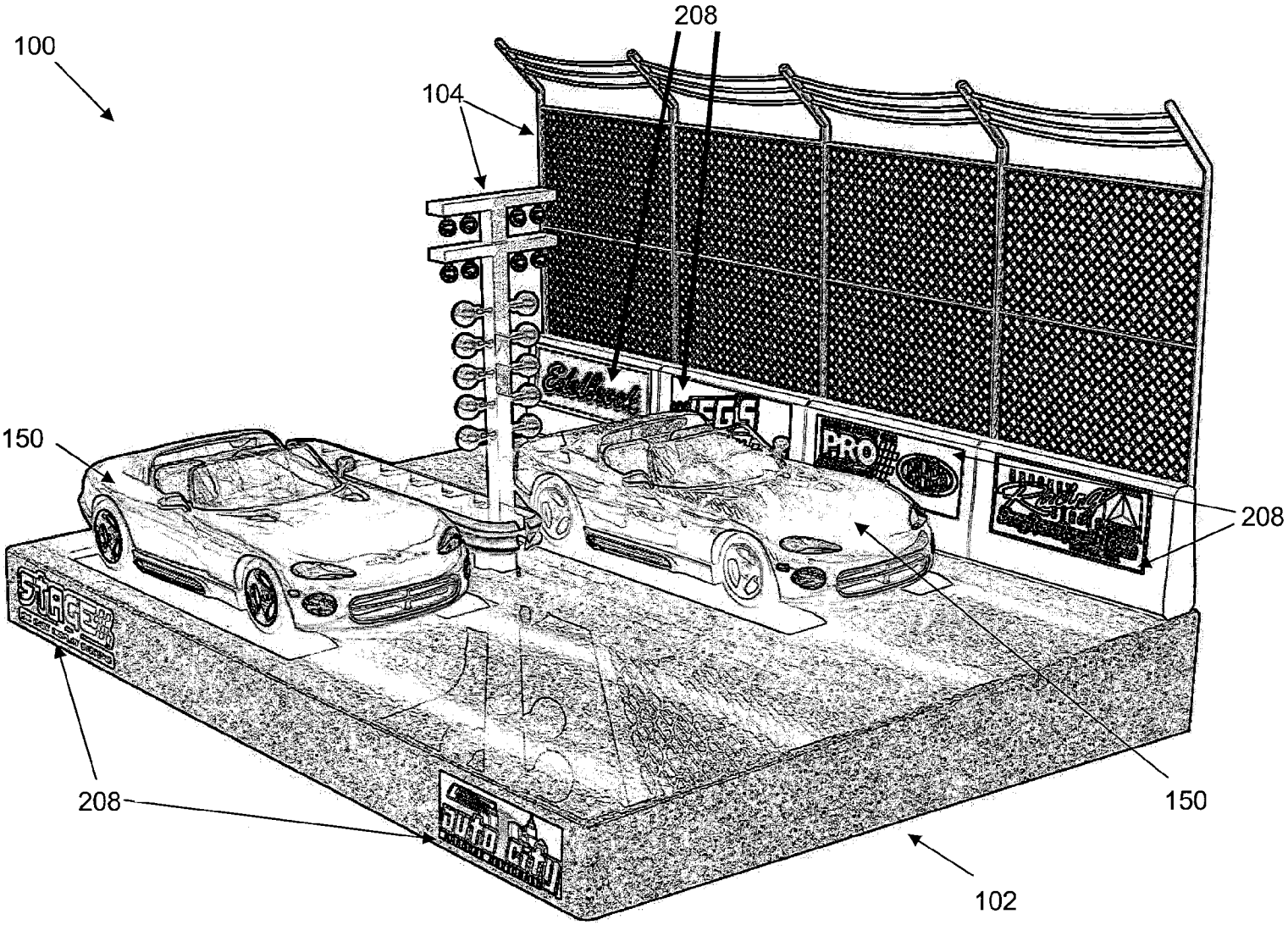
FIG. 1 is a perspective view of an example model car display system having two model cars associated therewith, according to the present invention.

In accordance with an example aspect, the present invention is directed to a model car display system for displaying at least one model car thereon. The system generally includes a base having a top surface adapted to support at least one model car thereon, a bottom surface and an inner cavity; and model car wheel rotating means adapted for selectably rotating one or more wheels of a model car, and wherein the rotating means is associated with the base in a manner that disposes it for ready engagement with a model car when the car is positioned atop the base top surface.

In accordance with yet another example aspect, the present invention is directed to a model car display system for displaying at least one model car thereon. The system generally includes a base having a top surface adapted to support at least one model car thereon, a bottom surface and an inner cavity; model car wheel rotating means adapted for selectably rotating one or more wheels of a model car, and wherein the rotating means is associated with the base in a manner that disposes it for ready engagement with a model car when the car is positioned atop the base top surface; and at least one scenic element removably associable with the base, wherein the at least one scenic element is configured to realistically portray in miniature an automobile-themed item.

In accordance with yet another example aspect, the present invention is directed to a model car display system for displaying at least one model car thereon. The system generally includes a base having a top surface adapted to support at least one model car thereon, a bottom surface and an inner cavity; model car wheel rotating means, comprising at least one track rotatably associated with the base, adapted for selectably rotating one or more wheels of a model car, and wherein the rotating means is associated with the base in a manner that disposes it for ready engagement with a model car when the car is positioned atop the base top surface; and at least one scenic element removably associable with the base, wherein the at least one scenic element is configured to realistically portray in miniature an automobile-themed item.

DETAILED DISCUSSION OF EXAMPLE EMBODIMENTS

Disclosed according to the present invention is a model car display system and use thereof. In general, the model car display system is adapted to receive one or more conventional model cars, such as a conventional scaled die-cast model car, and display the car in association with various scenic elements so as to simulate a scaled down version of a realistic scene in which a life sized car may be encountered. Example scenes contemplated for use in connection with the present invention include, but are not limited to, a car drag strip, a race track, a street race scene, a movie scene (e.g., to recreate a memorable scene from a motion picture), a historical scene, an auto show display, a highway scene, a conventional street, an intersection featuring buildings, a garage, and the like. The model car display system of the present invention provides an ideal complement for conventional model cars as model car enthusiasts are currently limited to enjoying their model cars in connection solely with their display divorced from any realistic elements on a shelf or similar display means, all of which currently do not provide realistic recreations of automobile-related scenes.

The model car display system of the present invention suitably provides a number of features that increase the aesthetic, commercial and realistic appeal of the system. In one embodiment, the system preferably includes various rotating means adapted for rotating the wheels of a model car positioned on the system, while maintaining the model car in a stationary position. By so rotating, the model car will appear to be in motion, thereby augmenting the realism of the scene created by the model car display system. In another embodiment, the system preferably includes various illuminated scenic elements. For example, the system may include illuminated street lights, street lamps, race track-associated countdown lamps, and the like. Such illuminated elements further increase the realism of the system. By way of yet another embodiment, the model car display system is preferably a modular and reconfigurable system adapted to interchangeably associate with a plurality of scenic elements, thereby enabling a user to create any of the above-mentioned or additionally contemplated scenes.

Turning to FIG. 1, illustrated is an example model car display system 100 according to the present invention. Generally, and as will be more fully described hereinafter, the system 100 includes a base 102 and various interchangeable scenic elements 104. In a preferred embodiment, the base 102 is a generally constant element of the system 100, with a plurality of various interchangeable scenic elements 104 being associable with the base 102 to create any of a number of scenes.

The system 100 base 102 of the present invention is adapted to interface with various scenic elements 104 to customize the appearance of the scene, and is further adapted to interface with one or more model cars 150 as a situs for the placement of the same. As previously mentioned, in a commercial embodiment, the base 102 is provided as a constant component of the system 100, and a user is able to purchase any of a number of scenic elements, each of which is associable with the base 102 to simulate any of a number of scenes. The base 102 preferably also includes various other components as previously briefly mentioned, such as the means adapted for rotating the model car's 150 wheels, and the like.

Figure 3:
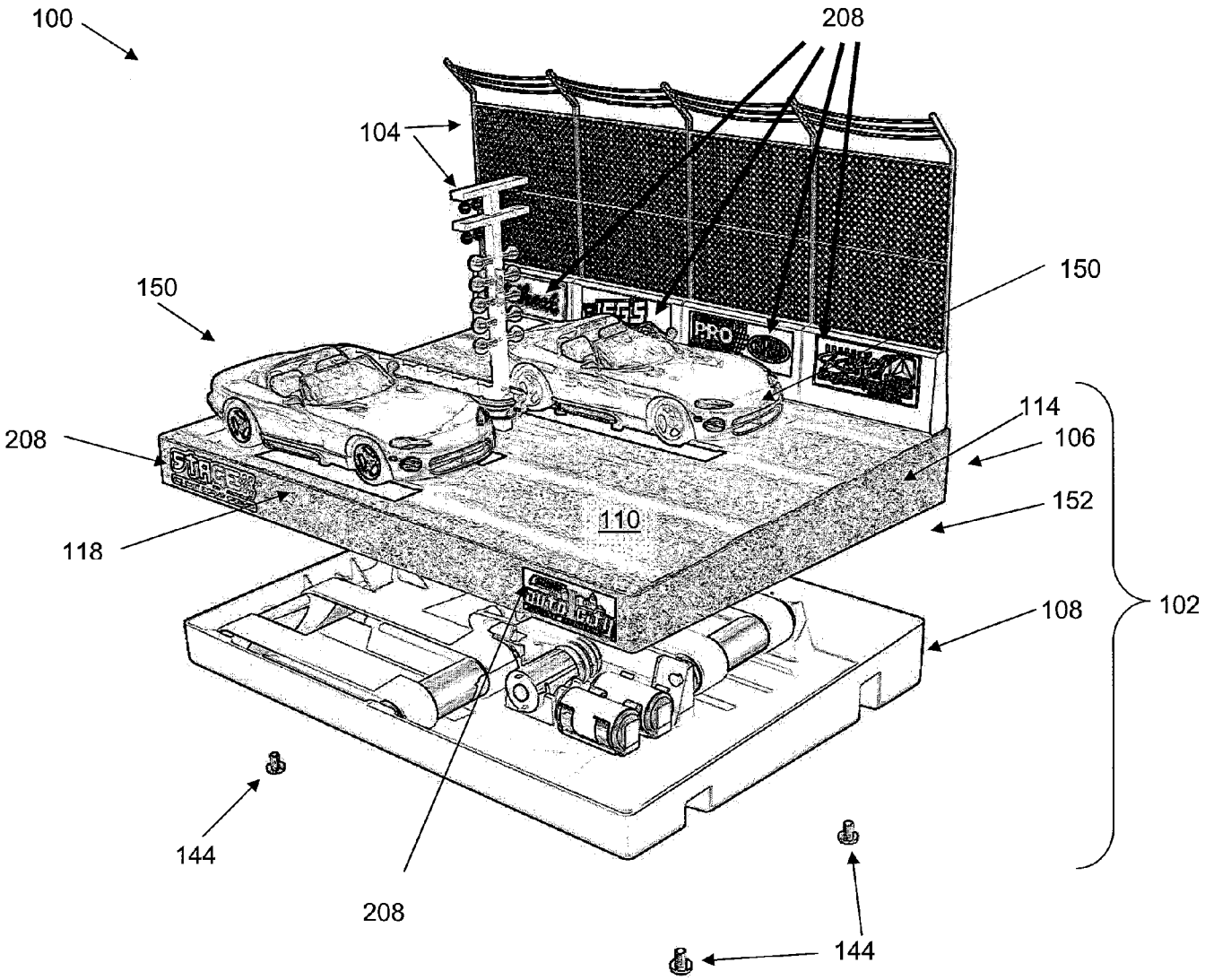
FIG. 3 is a partially exploded and perspective view of the model car display system of FIG. 1.

The base 102 is preferably, albeit optionally, provided as a two component element having a top, upper component 106, and a bottom, lower component 108, as best shown in FIG. 3. The top component 106 cooperates with the lower component 108 to define therebetween an inner cavity 152 in which various control elements are maintained, which elements suitably interact with the means adapted for rotating the car's 150 wheels, and the like, as will be more fully described hereinafter.

As shown in FIG. 3, the top component 106 of the base 102 preferably provides a situs for the positioning of a model car 150 and additionally provides various components that interface with the scenic elements 104. Additionally, the top component 106 is preferably a component of the base 102 that is exposed for ready visual inspection when the system 100 is positioned atop a substrate, such as a table, a shelf, a desk, and the like. In general, the top component 106 includes a top surface 110, a bottom surface 112 (see FIG. 9), a pair of opposed and spaced apart side walls 114, 116 (see FIGS. 5 and 6), a front wall 118 and a rear wall 120 (see FIG. 5).

Figure 9:
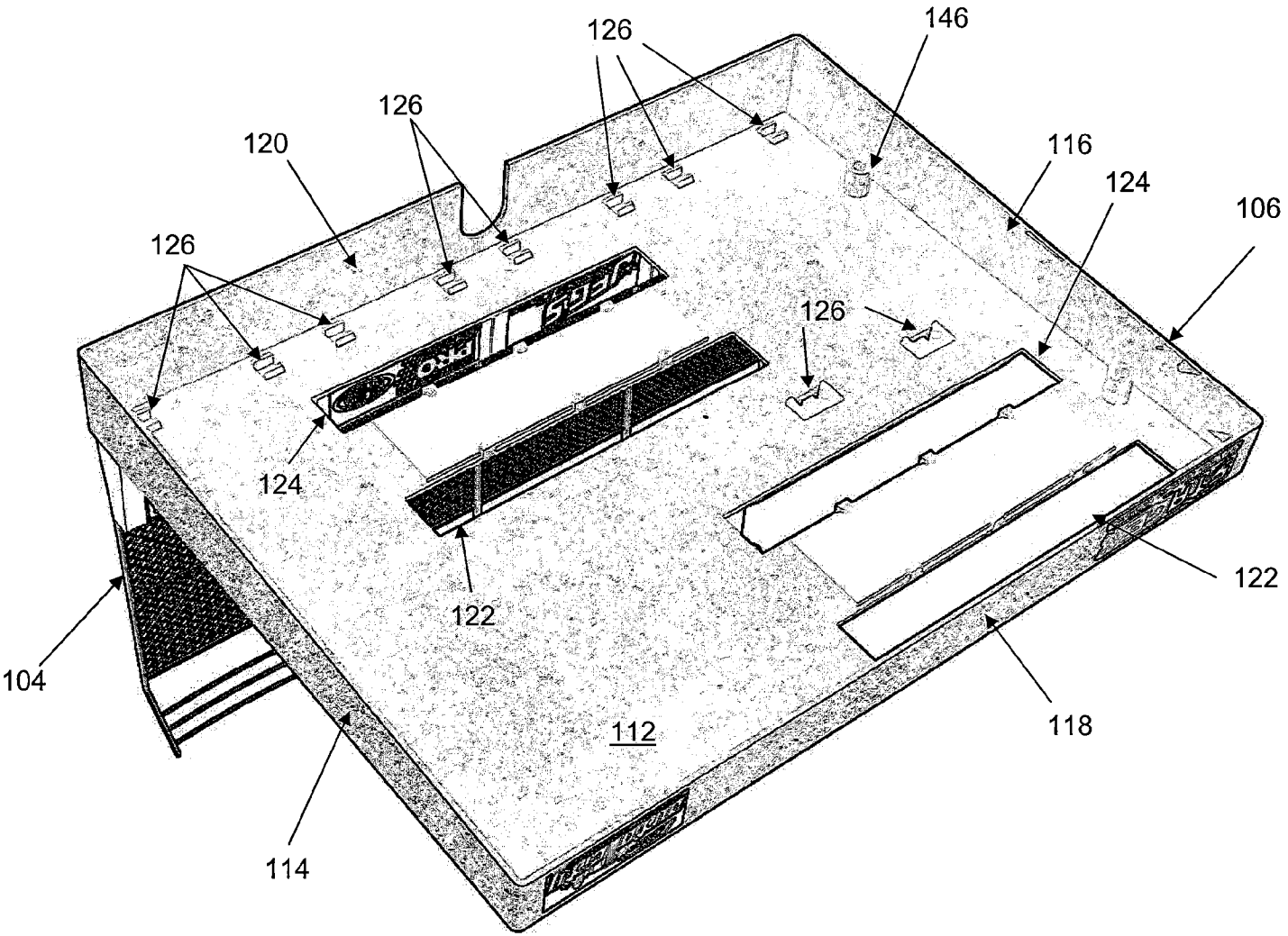
FIG. 9 is a bottom perspective view of a bottom surface of the top component of the base of the model car display system of FIG. 1.

The top surface 110 of the base 102 top component 106 generally operates as a substrate upon which the model car(s) 150 is positioned for display and additionally provides an interface for association with the various scenic elements 104. As best shown in FIG. 9, top surface 110 of the top component 106 is disposed generally along top portions thereof, with the walls 114, 116, 118, 120 directionally extending from the bottom surface 112 of the top component 106 and preferably perpendicularly relative thereto. In connection with the embodiment according to which the system 100 includes a means adapted for rotating the model car's 150 wheels, the top surface 110 preferably includes open slots 122, 124 for interfacing with the rotating means. Preferably, the top surface 110 additionally includes various apertures 126 for interfacing with complementary structure on scenic elements 104.

Figure 2:
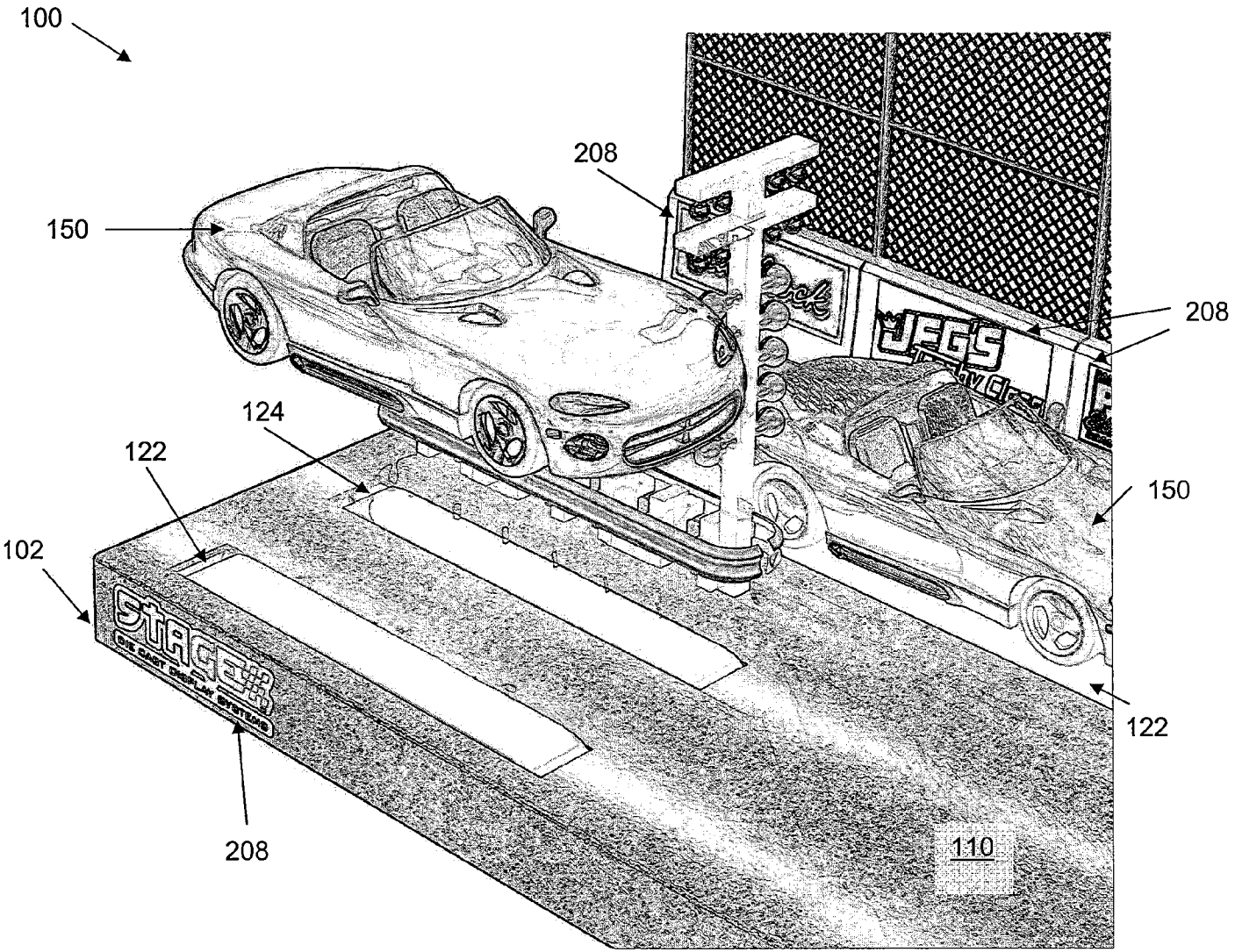
FIG. 2 is a partially exploded and perspective view of the model car display system of FIG. 1, wherein one of the model cars is elevated to illustrate various aspects of the system.
Figure 4:
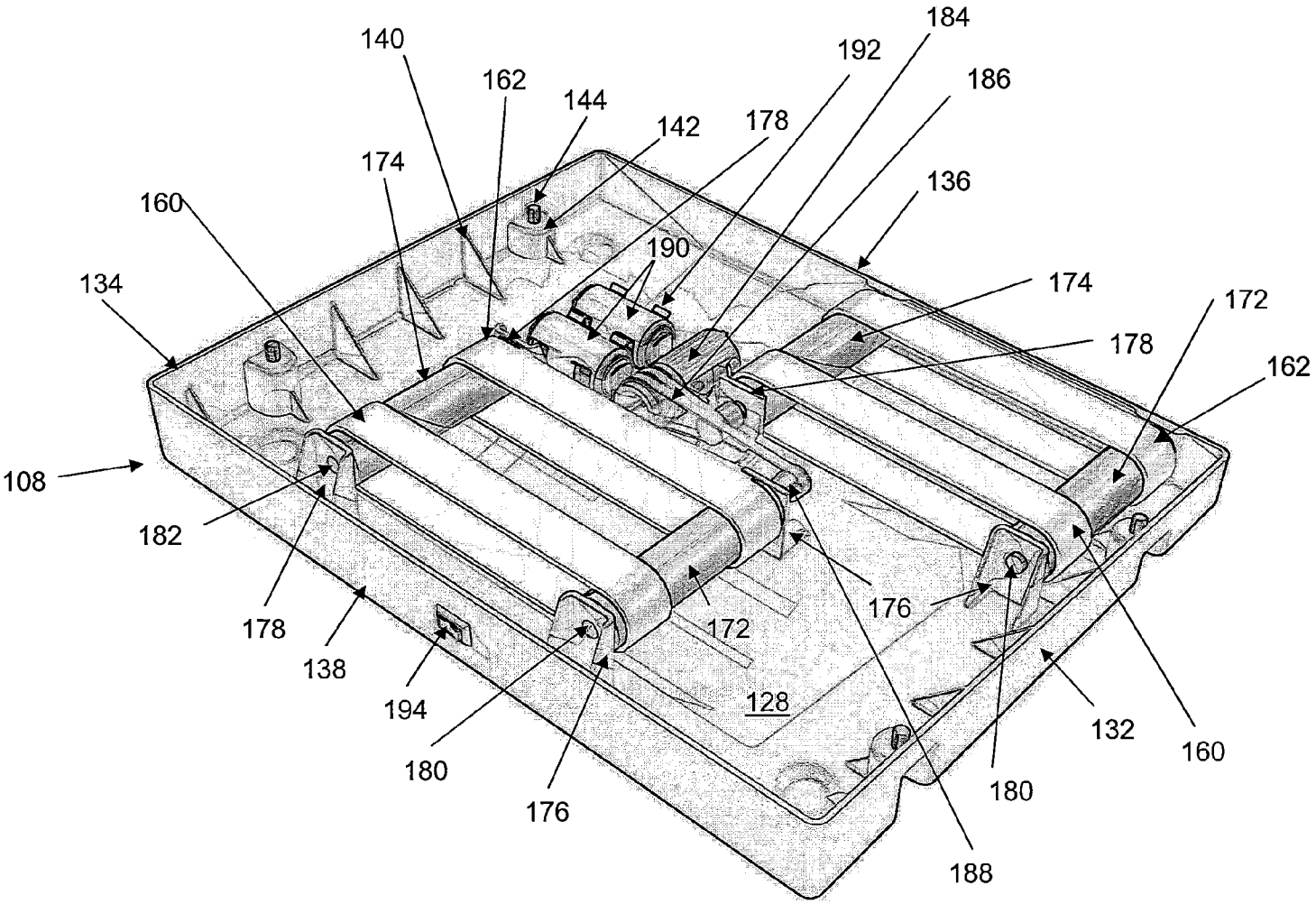
FIG. 4 is a perspective view of a bottom component of a base of the model car display system of FIG. 1.

In connection with a preferred embodiment and as previously briefly mentioned, the model car display system 100 of the present invention preferably includes a rotating means adapted for rotating the model car's 150 wheels while the model car 150 is securely associated with the system 100. Further thereto, as shown in FIG. 4, the rotating means is preferably provided as a pair of arcuately rectangularly rotating tracks 160, 162, each of which track 160,162 is adapted to be positioned parallel to a longitudinal axis of the model car 150 (shown in FIG. 1) and beneath a front and rear wheel of the same. Each track 160, 162 is preferably rotatable around a generally rectangular path of movement so that a generally planar, upper surface is created, upon which surface the wheels may suitably be positioned. As will be more fully described hereinafter, the rotating means is preferably a component of the control elements that is disposed in the inner cavity 152. Accordingly, the top surface 110 preferably includes a pair of rectangularly elongate slots 122, 124 for enabling the rotating means to be exposed to and be communicably associated with the model car's 150 wheels. More specifically, slot 122 enables the track 160 to rotate therein, and slot 124 enables the track 162 to rotate therein. Accordingly, when a model car 150 is positioned atop the top component 106 and the wheels of the same are positioned along the slots 122, 124, the rotating means may suitably translate its rotation into a force adapted for rotating the model car's 150 wheels. The slots 122, 124 are best viewed in connection with FIGS. 2, 6 and 9. Additionally, the slots 122, 124 are preferably provided in pairs, with one pair being provided for every model car 150 desired to be associated with the system 100. The Figures illustrate an embodiment of the invention in which the system 100 is adapted to display two model cars 150 simultaneously. Accordingly, two pairs of slots 122,124 are provided in connection with this embodiment. However, it is to be appreciated that the system 100 may suitably be adapted to display any of a number of desired model cars 150, with an appropriate number of slots 122, 124 being provided as dictated thereby.

As shown in FIG. 9, the top surface 110 additionally includes various apertures 126 fashioned therein for interfacing with complementary structure on the scenic elements 104. As previously mentioned in connection with a preferred embodiment, the system 100 is adapted to be reconfigurably associable with a plurality of various scenic elements 104, thereby enabling a user to customize the system 100 in accordance with the user's interests and taste. Accordingly, the apertures 126, along with appropriate structure on the scenic elements 104, provide a means for removably associating the scenic elements 104 with the system 100. Despite the foregoing, it is to be appreciated that the reconfigurable nature of the system 100 is by way of example only and is not to be construed as a limitation on or as a sole embodiment of the present invention. Specifically, the system 100 may suitably be provided in a plurality of different configurations, each of which suitably corresponds to one of a number of scenic creations.

Figure 6:
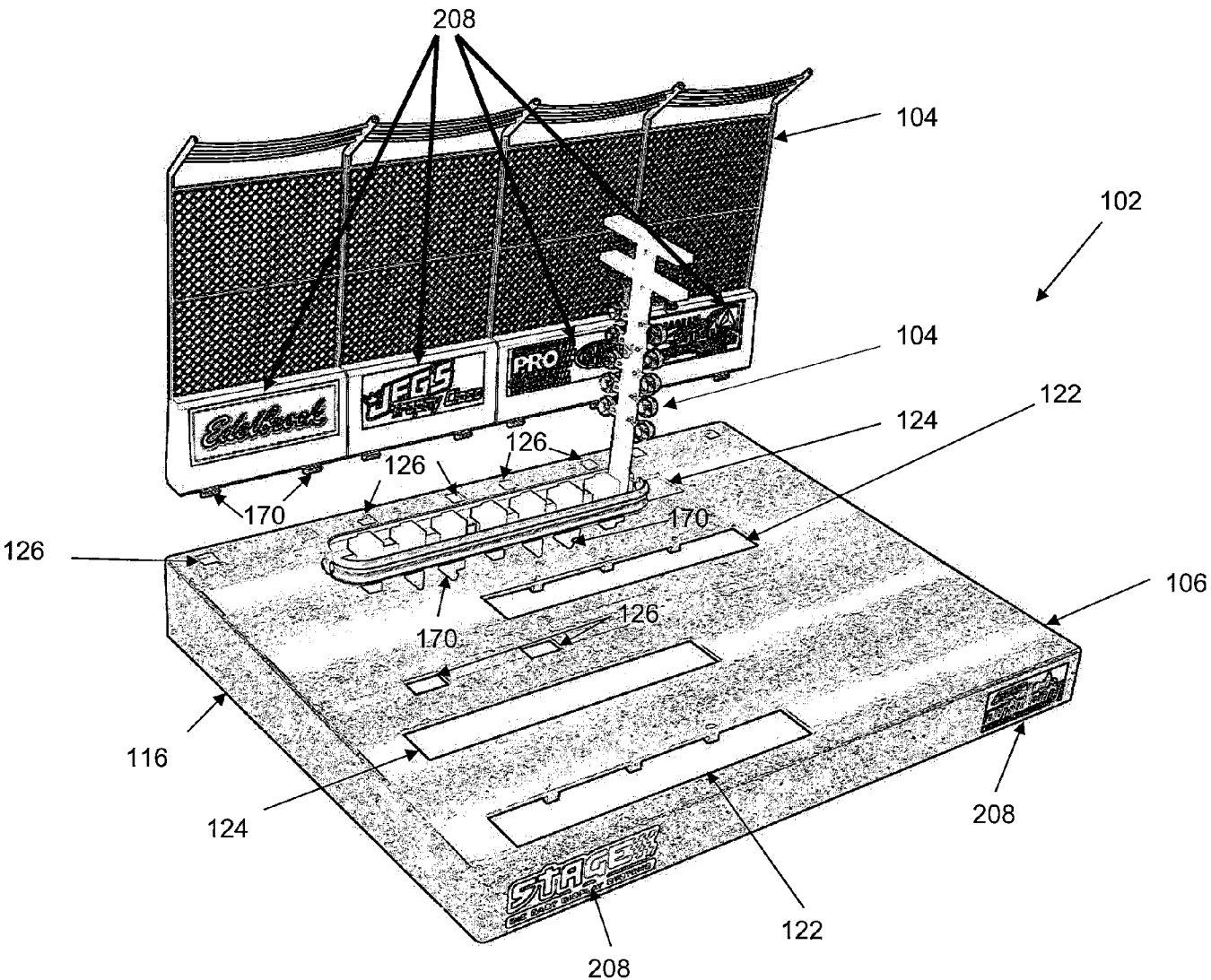
FIG. 6 is a front perspective and partially exploded view of various elements of a top component of a base and scenic elements of the model car display system of FIG. 1.
Figure 7:
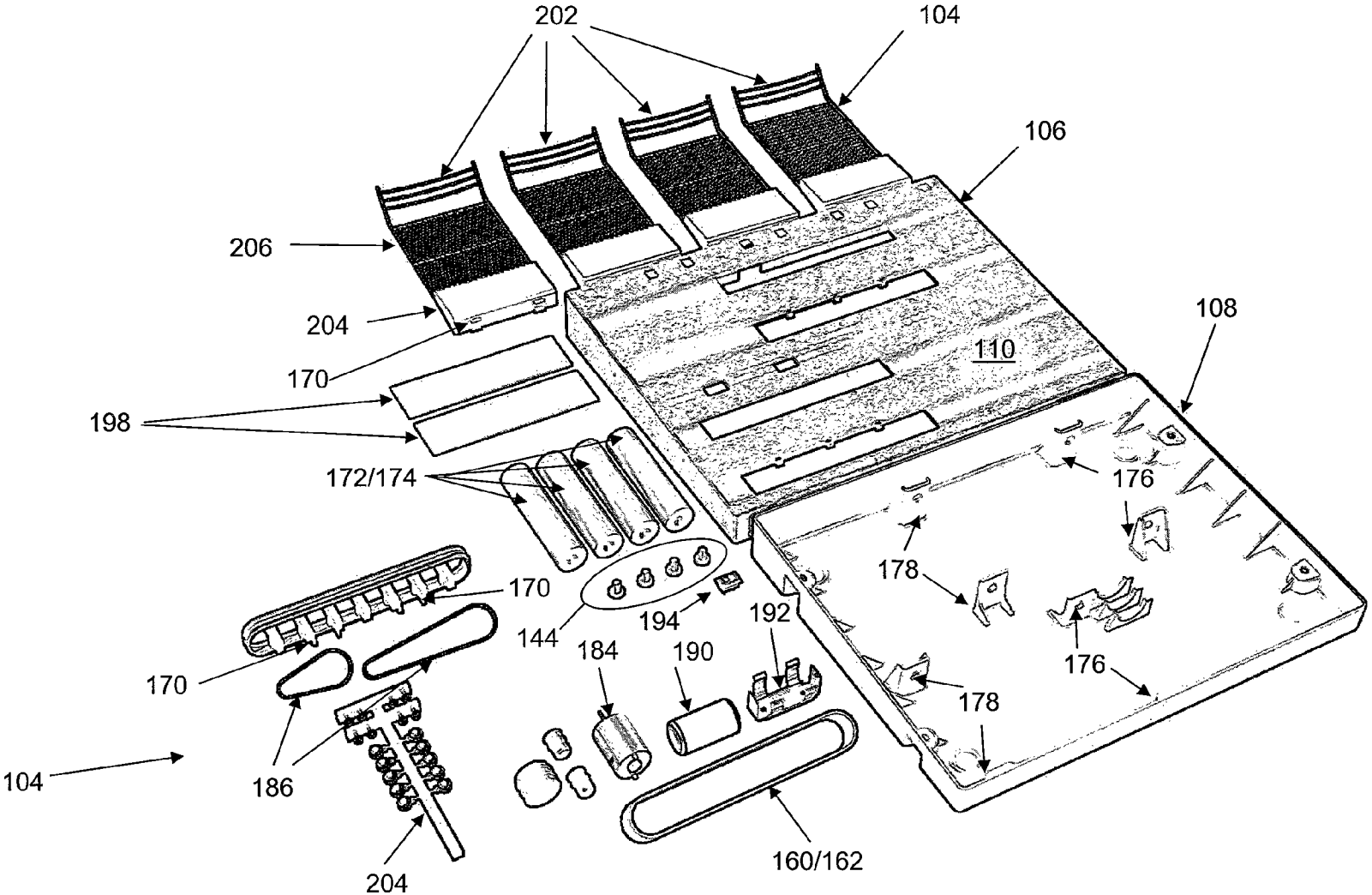
FIG. 7 is a perspective view of components of the model car display system of FIG. 1 arranged in a disassembled state.

Turning to FIGS. 6 and 7, the apertures 126 are preferably disposed in the top surface 110 of the base 102 top component 106. As shown in the referenced Figures, the scenic elements 104 preferably each include a projecting member 170 associated with a lower surface thereof and directionally pointing downward relative to the scenic element 104. The apertures 126 are provided as recesses downwardly recessed relative to the top surface 110, which recesses are adapted to removably receive the projecting member 170 of each scenic element 104 therein. FIG. 6 illustrates various scenic elements 104 vertically dissociated from the base 102. In operation, the projecting members 170 of the scenic elements 104 are inserted into the apertures 126. Preferably, the apertures 126 are provided of a certain depth and the projecting members 170 are provided of a certain length, such that association of the apertures 126 with the projecting members 170 suitably maintains the scenic elements 104 in an upright or otherwise as desired position.

Various other aspects of the top surface 110 are contemplated, some of which are manifest with reference to the Figures. For example, the top surface 110 may include additional features that enhance the realism of the appearance thereof. Example features include, but are not limited to, surface paint, various textures, tire skid marks, and the like.

The top component 106 additionally includes the bottom surface 112, side walls 114, 116, front wall 118 and rear wall 120. The bottom surface 112 is a surface of the top component 106 disposed generally parallel and in opposition to the top surface 110 thereof. As will be more fully described hereinafter, the bottom surface 112 is adapted to securely maintain various elements that cooperate in maintaining the model car 150 stationary and securely relative to the base 102. The side walls 114, 116 are preferably disposed in parallel and spaced apart relation to each other and further extend downward (relative to the top surface 110) from the bottom surface 112 perpendicularly relative thereto. The front and rear walls 118, 120 are preferably disposed as walls generally akin to the side walls 114, 116; namely, they extend parallel and spaced apart relative to each other and downward from the bottom surface 112 perpendicularly relative thereto.

In connection with a preferred and optional embodiment, the top component 106 is configured in a generally wedge-like shape that increases the aesthetic appeal of the system 100 and facilitates ready viewing of the features thereof. As shown in the Figures, the top component 106 is preferably disposed with the front wall 118 being disposed in a height that is less than the height of the rear wall 120. Because the top surface 110 of the top component 106 extends between the front wall 118 and the rear wall 120 atop the same, size differential between the front wall 118 and rear wall 120 suitably orient the top surface 110 to extend in an incline to the rear wall 120. The incline of the top surface 110 preferably orients the top component 106 in a preferred wedge-like configuration that angularly offsets features atop the top surface 110 for facilitated inspection and visual enjoyment.

The base 102 of the system 100 preferably also includes the bottom component 108 that cooperates with the top component 106 to complete the base 102. In general, as shown in FIG. 4, the bottom component 108 operates as an element adapted to interface the system 100 with a substrate upon which the system 100 is positioned, and additionally operates as a situs for the association of various control elements. In general, and with best reference to FIG. 4, the bottom component 108 includes a top surface 128, a bottom surface 130 (not shown), a pair of opposed and spaced apart side walls 132, 134, a front wall 136, and a rear wall 138.

The top surface 128 of the bottom component 108 preferably provides a surface upon which the various control elements are positioned and to which the same are secured. The control elements will be more fully described hereinafter. Additionally, the bottom component 108 is generally provided as a mirror and inverted image of the top component 106; accordingly, the top surface 128 extends along bottom edges of the walls 132, 134, 136, 138 of the bottom component 108. The bottom surface 130 is a surface of the bottom component 108 that is disposed generally coplanar with and spaced apart relative to the top surface 128. The side walls 132, 134 are preferably disposed in parallel and spaced apart relation to each other and further extend upward (relative to the bottom surface 130) from the top surface 128 perpendicularly relative thereto. The front and rear walls 136, 138 are preferably disposed as walls generally akin to the side walls 132, 134; namely, they extend parallel and spaced apart relative to each other and upward from the top surface 128 perpendicularly relative thereto. The bottom component 108 may additionally include a plurality of rib-like members 140 disposed between the top surface 128 and various walls 132, 134, 136, 138 thereof for increasing the structural rigidity of the base 102.

In connection with a preferred embodiment, the top component 106 and the bottom component 108 are removably securable to each other so that maintenance andor repair-related access may be provided to the inner cavity 152 and control elements thereof. In an embodiment, the bottom component 108 includes on its top surface 128 a plurality of bosses 142, each of which are suitably adapted to receive a screw 144 (FIG. 3) upwardly therethrough, in a configuration by which a threaded component of the screw 144 is exposed atop the boss 142. Additionally, the top component 106 includes a plurality of corresponding receiving bosses 146 (see FIG. 9) adapted to securely interface with the screw 144 as exposed from the bottom component 108 bosses 142. The screw(s) 144 preferably operate in a conventional manner to reversibly associate the top component 106 with the bottom component 108.

As previously mentioned, the model car display system 100 preferably also includes various control elements for directing and/or controlling various functional aspects of the system 100. In connection with a preferred embodiment, an example of which is shown in FIGS. 4 and 7, the control elements include the rotating means adapted for rotating the model car's 150 wheels, and additionally include various electricity-supplying elements to power various scenic elements that include illumination capable components.

The system 100 preferably includes the rotating means adapted for rotating a model car's 150 wheels when the model car 150 is positioned atop the base 102. As previously mentioned, the rotating means includes a number of rotating elements adapted to transfer the rotational energy thereof to the model car's 150 wheels to rotate the same. With best reference to FIGS. 3, 4 and 7, the rotating means includes a pair of rotating tracks 160, 162 that are adapted to rotate and be exposed through the top component 106 slots 122, 124. The rotating tracks 160, 162 are preferably associated with various elements that control and direct the rotation of the same. In an example embodiment, the tracks 160, 162 are associated with a pair of right cylindrical roller members 172, 174. More specifically, the rollers 172, 174 are preferably rotationally supported in association with the top surface 128 of the bottom component 106, as best seen in FIG. 4, through appropriate support members 176, 178. Each roller 172, 174 preferably includes a pair of terminal projecting cylinders 180, 182 that are rotatably engaged by the support members 176, 178, thereby enabling the rollers 172, 174 to be spaced apart from the bottom component 108 and to be rotatable. The tracks 160, 162 are preferably oriented around the rollers 172, 174, with the rollers 172, 174 positioned to tautly stretch the tracks 160, 162. Additionally, the rollers 172, 174 may suitably include various structure thereon, such as circumferentially raised portions, for securely maintaining the tracks 160, 162 thereon and preventing the same from slipping off the rollers 172, 174.

In an additionally preferred embodiment, one or more of the rollers 172, 174 are communicatively coupled to a motor or similar source of energy adapted for driving the rotation of the same. With continued reference to FIG. 4, the rotating means preferably also includes a motor 184 that is operatively coupled to one of the rollers 172, 174, which motor includes a rotating element that is adapted to transfer a rotational energy to the roller 172, 174 for rotating the same. Because of the association between the track 160, 162 and the roller 172, 174, rotation of the roller 172, 174 suitably causes rotation of the track 160, 162. The motor 184 is preferably provided as a conventional motor adapted to communicably associate with the roller 172, 174 through a belt 186 that is associated with both the motor 184 and a protruding member 188 of the roller 172, 174. As depicted in FIG. 4, the system 100 may suitably include a pair of rotating means for driving rotation of the wheels of two model cars 150 positioned atop the base 102. Accordingly, the motor 184 may suitably be adapted to simultaneously drive both rotating means through a pair of belts 186, substantially as shown.

The motor 184 preferably couples to any suitable source of conventional electrical power. As shown in FIG. 4, the motor 184 is operatively associated with one or more batteries 190, which, as known, provide power to the motor to operate the same. The batteries 190 are preferably associated with the bottom component 108 through conventional biasing fasteners 192, or through any other suitable structure. It is to be appreciated that the motor 184 may suitably couple to a conventional electrical power cord (not shown), which is adapted to couple to a socket source of electricity and permit transfer of the electricity to the motor.

Figure 5:
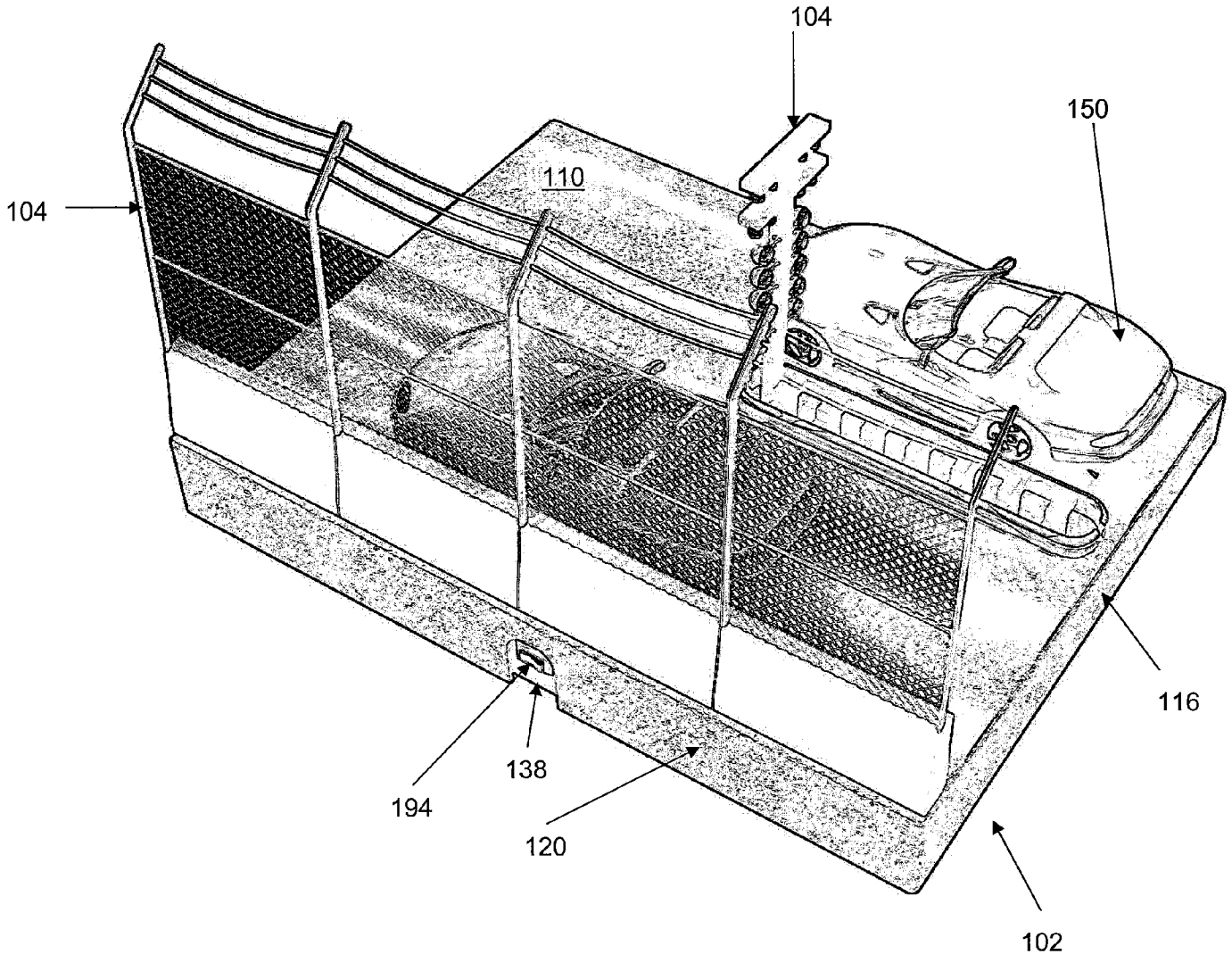
FIG. 5 is a rear perspective view of the model car display system of FIG. 1.

The motor 184 is preferably also operatively associated with a toggle for alternatively associating or dissociating the motor 184 with electricity. In a preferred embodiment and as shown in FIGS. 4 and 5, the system 100 preferably includes a conventional switch 194 that is operatively associated with the control elements in a manner that its activation suitably permits the flow of electricity to the motor 184, and its deactivation suitably prevents the flow of electricity to the motor 184. As shown, the switch 194 is preferably disposed on an exterior of the rear wall 138 of the bottom component 108. It is to be appreciated that the switch 194 is an optional component and need not be provided; particularly, in the embodiment in which the system 100 includes an electrical cord, the flow of electricity to the motor 184 may suitably be controlled through insertion and/or removal of the cord relative to the socket. Additionally, the switch may suitably be directly associated with the electrical cord, or in any other suitable configuration.

Figure 8:
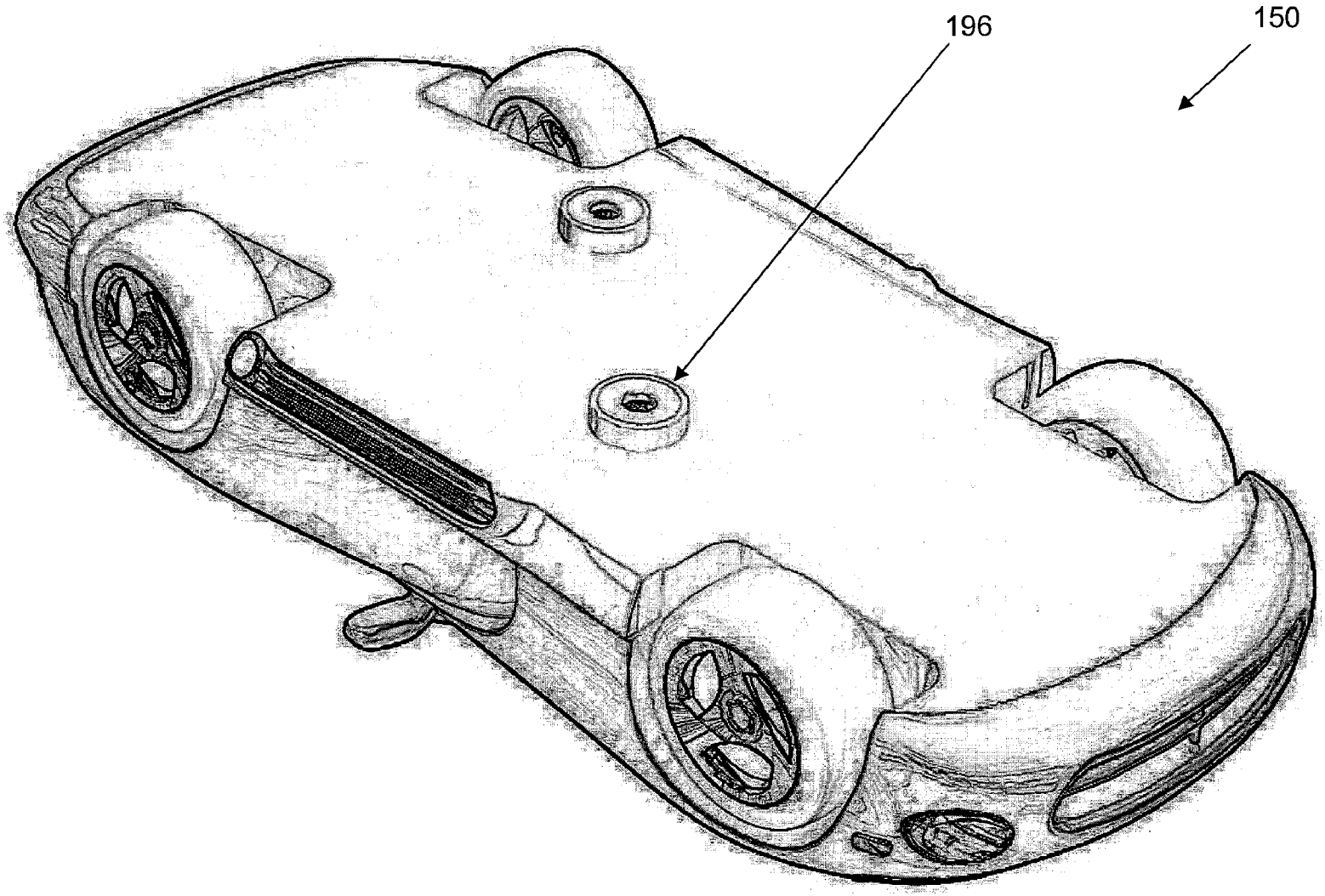
FIG. 8 is a bottom perspective view of an example model car associable with the model car display system of FIG. 1.

The model car display system 100 of the present invention suitably also includes an associating means adapted for securely associating a model car 150 with the system 100. In connection with the preferred embodiment in which the system 100 includes the rotating means for rotating the wheels of the model car 150 associated with the system 100, the associating means preferably operates to maintain the model car 150 atop the device 100 while the wheels thereof are being rotated by the rotating means. In a preferred embodiment, the associating means is provided as a plurality of magnets that cooperate to maintain the model car 150 on the base 102. More specifically, the model car 150 preferably includes a magnet 196, as shown in FIG. 8, removably associable therewith. As conventionally known, model cars typically are associated with a retail display case, in which the car is commercially packaged, through a threaded fastener that associates with a threaded and bored hole along a bottom surface thereof. In the present preferred embodiment, the magnet 196 is associated with a threaded screw-like member extending perpendicularly relative to a longitudinal and magnetically active surface thereof. Accordingly, the magnet 196 is preferably threadably associable with the model car 150 along a bottom surface thereof. It is to be appreciated that one or more magnets 196 may suitably be associated with the model car 150 as desired.

With reference to FIG. 9, the base 102 preferably includes a magnet 198 (see FIG. 7) associated therewith for interacting with the model car 150 magnet 196 in securing the same to the base 102. More preferably, the magnet 198 is provided as a planar and rectangularly elongate magnet 198 disposed in association with the bottom surface 112 of the top component 106. Even more preferably, the magnet 198 is disposed along the bottom surface 112 in a position generally disposed between the open and elongate slots 122, 124. The bottom surface 112 preferably includes a plurality of clip-like fastening members 200 adapted to securely associate the magnet 198 with the base 102.

Accordingly, in operation, the magnet 196 associated with the model car 150 suitably magnetically cooperates with the magnet 198 of the base 102 to secure the model car 150 thereon. In the preferred embodiment, the magnets 196, 198 suitably cooperate along a path that is disposed generally between the rotating tracks 160, 162. Therefore, the magnets 196, 198 securely maintain the model car 150 atop the base 102 while the rotating means is driving the rotation of the model car's 150 wheels.

Despite the disclosure of the magnets 196, 198 as the associating means, it is to be appreciated that the model car 150 may be securely associated with the base 102 through any appropriate fastening and/or associating means. For example, various fasteners, such as clips, rubber bands, and the like, may suitably be provided to mechanically fasten the model car 150 to the base 102.

As previously mentioned, the control elements variously also include an electricity-supplying means for delivering power to illumination-capable scenic elements 104. In a preferred embodiment, the electricity supplying means is communicatively coupled to the selected source of electricity used to drive the rotating means. Accordingly, the electricity-supplying means may suitably be coupled to the battery(ies) 190, to an electrical power cord, or the like. Additionally, various electrical circuitry is preferably provided to deliver electricity from the selected source of electricity to the various scenic elements 104 as necessary. For example, the scenic elements 104 may suitably receive electricity through a coupling created by association of the aperture 126 and the projecting members 170 of the scenic elements 104. More specifically, an electrical terminal may be provided to the aperture 126 and another electrical terminal may be provided in the projecting members 170. Accordingly, when the terminals of the aperture 126 and the projecting member 170 meet, a circuit is completed and electricity is delivered therethrough.

As previously mentioned, the model car display system 100 of the present invention suitably includes scenic elements 104 associated therewith for creating a realistic, scaled-down automobile-related scene. As previously mentioned, the scenic elements 104 may be fashioned in any of a plurality of configurations to realistically portray the appearance of a plurality of scenes, such as the scenes delineated above. As also previously mentioned, the scenic elements 104 are preferably removably associable with the base 102 so that any of a plurality of scenes can be created with the same base 102.

Turning to FIG. 7, illustrated is a set of example scenic elements 104 configured to appear as and create a scene generally corresponding to a race track-like drag strip. The scenic elements 104 generally include a wall portion 202 and an illuminated lamp portion 204. The wall portion 202 is adapted to be positioned along a rear portion of the base 102, generally collinear with and parallel to the rear wall 120 (see FIG. 5) -of the top surface 110 and generally includes a bottom boundary portion 204, generally corresponding to an actual concrete barrier, and a fence portion 206 extending vertically therefrom. The illuminated lamp portion 204 is adapted to correspond to an actual lamp-like member having a plurality of lamps, alternative actuation of which suitably provides a start signal to racing cars, as conventionally known. The lamp portion 204 may suitably include various elements that illumination in response to the receipt of electricity from the electricity-supplying means. Additionally, the lamp portion 204 may suitably variously illuminate in a plurality of sequences, which may suitably correspond to conventional race start conditions. The illumination sequences may suitably loop and continuously repeat insofar as the lamp portion 204 continues to receive electricity. It is to be appreciated that the scenic elements 104 may suitably be modified so as to, correspond to any of a desired scene.

The model car display system 100 of the present invention may suitably be adapted to display various informational and/or advertising information thereon. As shown in FIGS. 1, 2, 3 and 6, the scenic elements 104, particularly the exemplary boundary portion 206 may include various labels, decals or other informational propaganda 208 thereon. As shown especially in FIGS. 1 and 2, aspects of the body 102 may also be so suitably modified. The advertising capacity of the system 100 provides an opportunity for cross licensing and other branding programs for automobile industry-related parties.

Although the invention has been described with regard to certain preferred example embodiments, it is to be understood that the present disclosure has been made by way of example only, and that improvements, changes and modifications in the details of construction and the combination and arrangement of parts may be resorted to without departing from the spirit and scope of the invention. Such improvements, changes and modifications within the skill of the art are intended to be covered by the scope of the claims.

What is claimed is:

1. A model car display system comprising:

a base having a top surface adapted to support at least one model car thereon, a bottom surface and an inner cavity;

a rotatable element rotatably associated with the base, wherein the top surface of the base comprises at least one open channel wherein at least a portion of the rotatable element passes through the open channel, said rotatable element adapted to simultaneously engage at least one front wheel of the model car and at least one rear wheel of the model car, wherein the rotatable element comprises a track comprising a belt disposed around two or more rollers, said belt defining a rotational path of the track, and wherein at least a portion of the rotational path of the track is substantially planar, and wherein the substantially planar portion of the track rotational path is disposed along the open channel;

a model car retention member affixed to the base to removably retain the model car to the base; and a scenic element removably associated with the base, said scenic element selected from the group consisting of a wall, a lamp, a fence, and a barrier.

2. The model car display system of claim 1 further comprising a second scenic element removably associated with the base.

3. The model car display system of claim 1 wherein the track simultaneously engages the front wheel and the rear wheel of the model car.

4. The model car display system of claim 1 wherein the scenic element comprises an advertisement.

5. The model car display system of claim 1, wherein the model car retention member is affixed to the top surface of the base.

* * * * *